US010865532B2

(12) United States Patent
Kraus

(10) Patent No.: US 10,865,532 B2
(45) Date of Patent: Dec. 15, 2020

(54) LATERALLY SHIFTABLE PLOW

(71) Applicant: CIVES CORPORATION, Alphretta, GA (US)

(72) Inventor: Kory Kraus, Cape Girardeau, MO (US)

(73) Assignee: CIVES CORPORATION, Alpharetta, GA (US)

( * ) Notice: Subject to any disclaimer, the term of this patent is extended or adjusted under 35 U.S.C. 154(b) by 0 days.

(21) Appl. No.: 16/051,918

(22) Filed: Aug. 1, 2018

(65) Prior Publication Data

US 2020/0040540 A1 Feb. 6, 2020

(51) Int. Cl.
*E01H 5/06* (2006.01)

(52) U.S. Cl.
CPC ..... *E01H 5/061* (2013.01); *E01H 5/062* (2013.01); *E01H 5/066* (2013.01)

(58) Field of Classification Search
CPC ..... E01H 5/061; E01H 5/062; E01H 5/066; E01H 5/098
See application file for complete search history.

(56) References Cited

U.S. PATENT DOCUMENTS 5,079,866 A * 1/1992 Farrell ..... E01H 5/065 37/233
5,974,702 A * 11/1999 Donoghue ..... E01H 5/062 172/819
8,967,286 B2 * 3/2015 Kois ..... E01H 5/061 172/272
2007/0271828 A1 * 11/2007 Mishra ..... E01H 5/06 37/231
2010/0218401 A1 * 9/2010 Mishra ..... E01H 5/06 37/197
2010/0229431 A1 * 9/2010 Mishra ..... E01H 5/06 37/197

OTHER PUBLICATIONS

Office Action dated Sep. 18, 2020, by the Canadian Intellectual Property Office in corresponding Canadian Patent Application No. 3,050,901. (3 pages).

* cited by examiner

*Primary Examiner* — Tara Mayo-Pinnock

(74) *Attorney, Agent, or Firm* — Buchanan Ingersoll & Rooney PC

(57) ABSTRACT

A side shift push frame assembly including a bracket arranged on a first side and configured to be attached to a vehicle, a frame configured to be attached to the bracket, a mold board support beam arranged on the frame on a side opposite to the bracket, and configured to be attached to a mold board. An actuator is configured to be attached to the mold board for moving the mold board in a lateral direction relative to the frame while the frame remains in a fixed position.

22 Claims, 7 Drawing Sheets

LATERALLY SHIFTABLE PLOW

FIELD OF THE INVENTION

The present invention relates to plows and more particularly a laterally shiftable plow such as a snow plow.

BACKGROUND OF THE INVENTION

Snow is typically removed from pavement such as roads, highways, runways, and the like by a truck that includes a snow plow with a mold board that is mounted on the front end of truck. A variety of arrangements exist for raising and lowering the mold board, changing the angle the mold board makes with the longitudinal axis of the truck and with respect to the longitudinal axis of the pavement being cleared. The lowermost edge of the mold board may contact or be in near contact with the pavement being plowed or may be lifted to be out of contact with the road (e.g., by several inches or feet) so that, for example, pavement already cleared of snow is not again plowed and obstructions may be cleared, such as speed bumps.

During a plowing operation, it is conventional to raise and lower the mold board of the snow plow as desired and to change the angle that the mold board of the snow plow makes with the longitudinal center axis of the truck, and therefore with respect to the longitudinal axis of the lane of pavement being cleared.

The mold board of the snow plow may be selectively raised and lowered so that the plow truck may be driven with the lowermost edge of the mold board either in contact (for conducting a plowing operation) or out of contact with the road, such as when the truck is being driven over pavement which has already been cleared of snow. Also, the snow plow is typically arranged to enable the angle of the plow with respect to the truck to be changed so that the snow plow can be used to divert snow to the left or to the right of the truck or used to push snow directly in front of the truck such as when clearing a driveway or parking lot.

A wing plow or another attachment may be provided to effectively extend the width of the lane that can be plowed by a single truck in a single pass. Such wing plows are typically mounted at one side of the truck. Snow plow vehicles at airfields may sometimes have a front plow blade and a broom which is towed by the vehicle.

In conventional snow plows, if it is needed to clear snow or ice from the shoulder of a road such as a highway, the tires of the truck may be forced to contact rumble strips arranged on the road or highway edge, or even outside of the rumble strips. The tires of the truck may have to ride on the shoulder or become dangerously close to a gully or other depression arranged on the side of the road. This creates an uncomfortable ride for the driver and can even be dangerous for the driver and motorists traveling around him. It is desirable for the truck to travel on the road or highway so as to be centered in a driving lane as much as possible.

Thus, there is a need for a plowing mechanism that can allow a vehicle carrying the plowing mechanism to remain centered in a driving lane while still being able to clear snow, ice or other debris from a shoulder of a road or highway.

SUMMARY OF THE INVENTION

A side shift push frame assembly according to an exemplary embodiment of the disclosure includes a bracket arranged on a first side and configured to be attached to a vehicle, a frame configured to be attached to the bracket, a mold board support beam arranged on the frame on a side opposite to the bracket, and configured to be attached to a mold board. An actuator is configured to be attached to the mold board for moving the mold board in a lateral direction relative to the frame while the frame remains in a fixed position.

A side shift push frame assembly according to an exemplary embodiment of the disclosure includes at least one upper slide shaft arranged on the frame, a resilient force assembly including at least one resilient member configured to impart a force on the mold board. The at least one resilient force assembly is configured to be fixed to the mold board at one end, and at another opposite end includes at least one bore for receiving a respective slide shaft of the at least one upper slide shaft which is configured to travel through the bore. The resilient force assembly is configured to move along with the mold board.

A side shift push frame assembly according to an exemplary embodiment of the disclosure is provided in combination with a mold board. The mold board includes at least one upper flange arranged on an upper part of the mold board and connected to the resilient force assembly, and a lower slide shaft. A mold board support beam includes a plurality of flanges each having a bore, the lower slide shaft being arranged to slide laterally in the bores of the plurality of flanges and is supported thereby.

A motor vehicle including a side shift push frame assembly according to an exemplary embodiment of the disclosure, the side shift push frame assembly including a bracket arranged on a first side and configured to be attached to the motor vehicle, a frame configured to be attached to the bracket, a mold board support beam arranged on the frame on a side opposite to the bracket, and configured to be attached to a mold board. An actuator is configured to be attached to the mold board for moving the mold board in a lateral direction relative to the frame while the frame remains in a fixed position.

Additional features and advantages of the invention will be set forth or be apparent from the description that follows. The features and advantages of the invention will be realized and attained by the structures and methods particularly pointed out in the written description and claims hereof as well as the appended drawings. It is to be understood that both the foregoing general description and the following detailed description are exemplary and explanatory and are intended to provide further explanation without limiting the scope of the invention as claimed.

BRIEF DESCRIPTION OF THE DRAWING FIGURES

Figure 1:
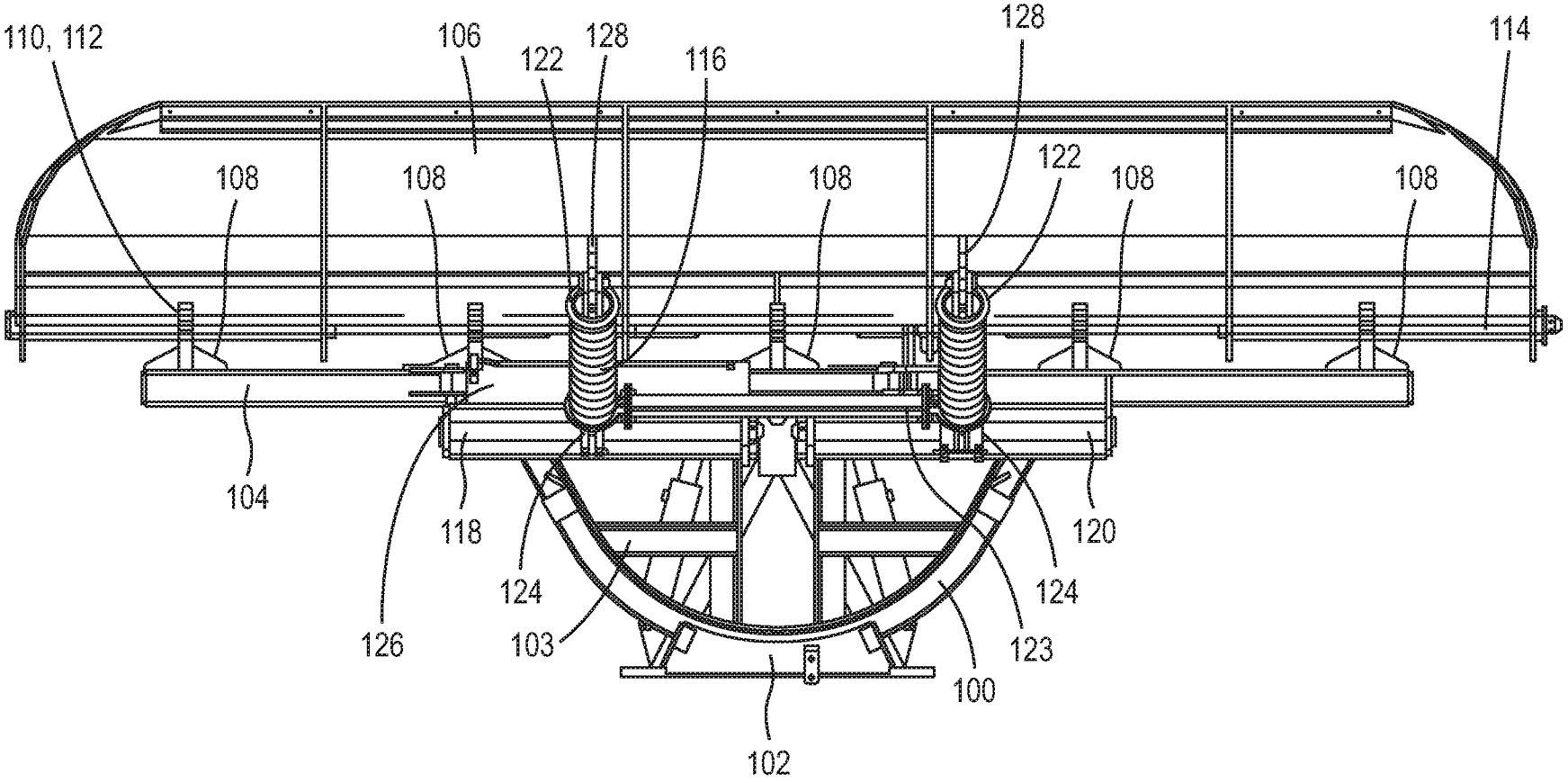
FIG. 1 depicts a plan view of a shiftable plow according to an exemplary embodiment of the disclosure.
Figure 3:
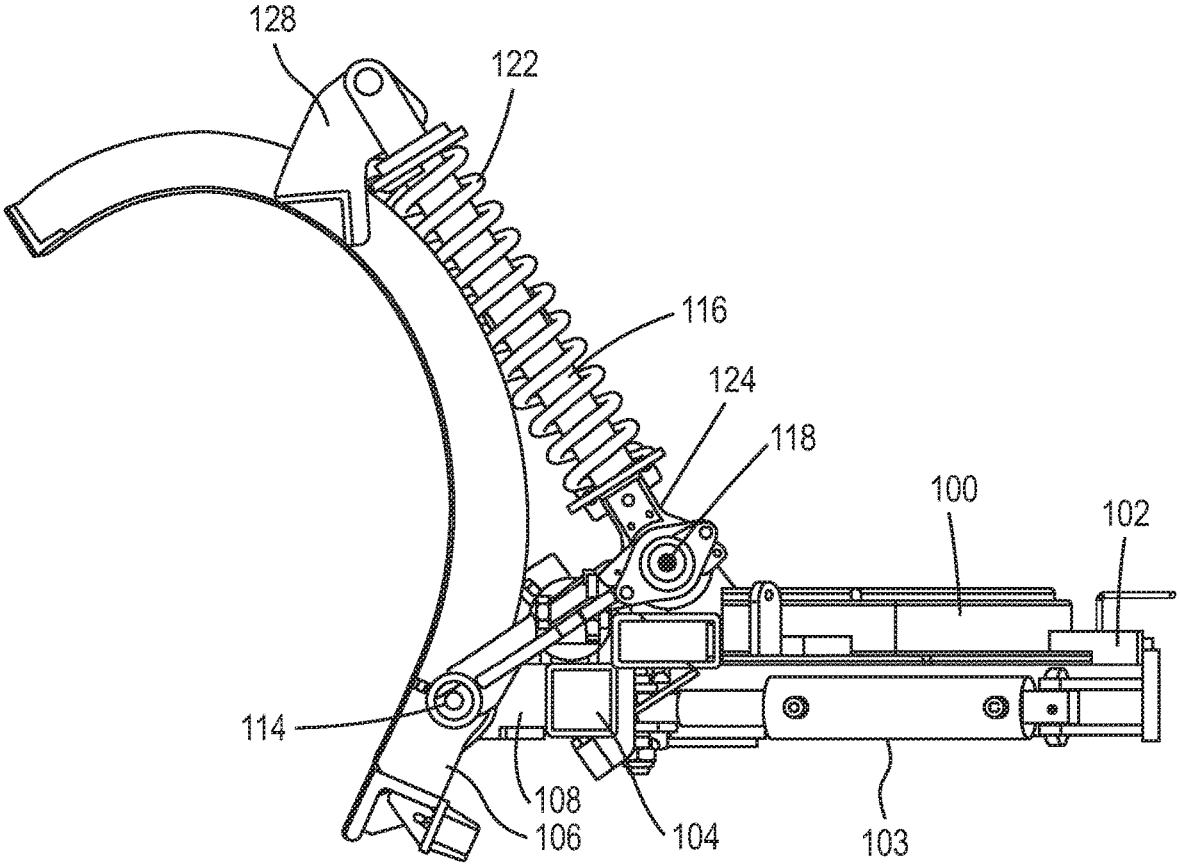
Figure 4:
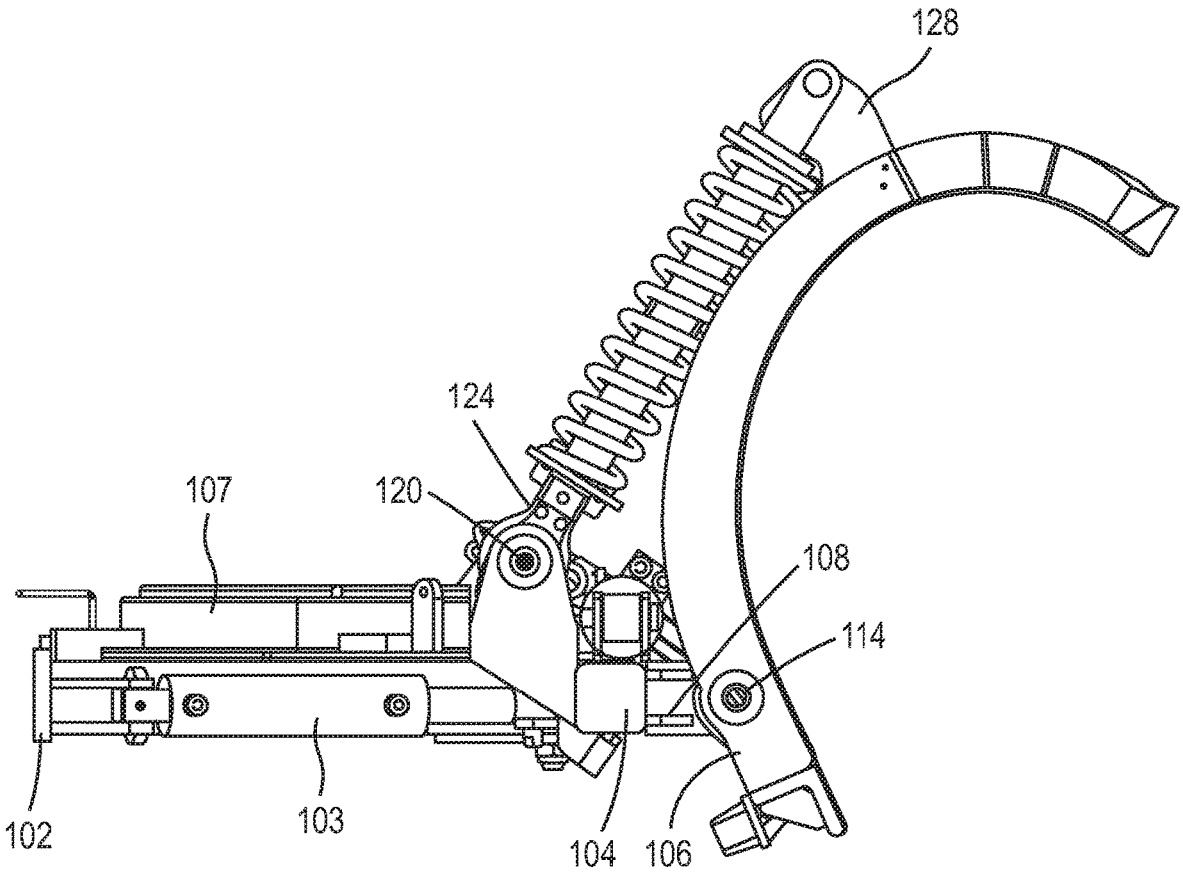
Figure 5A:
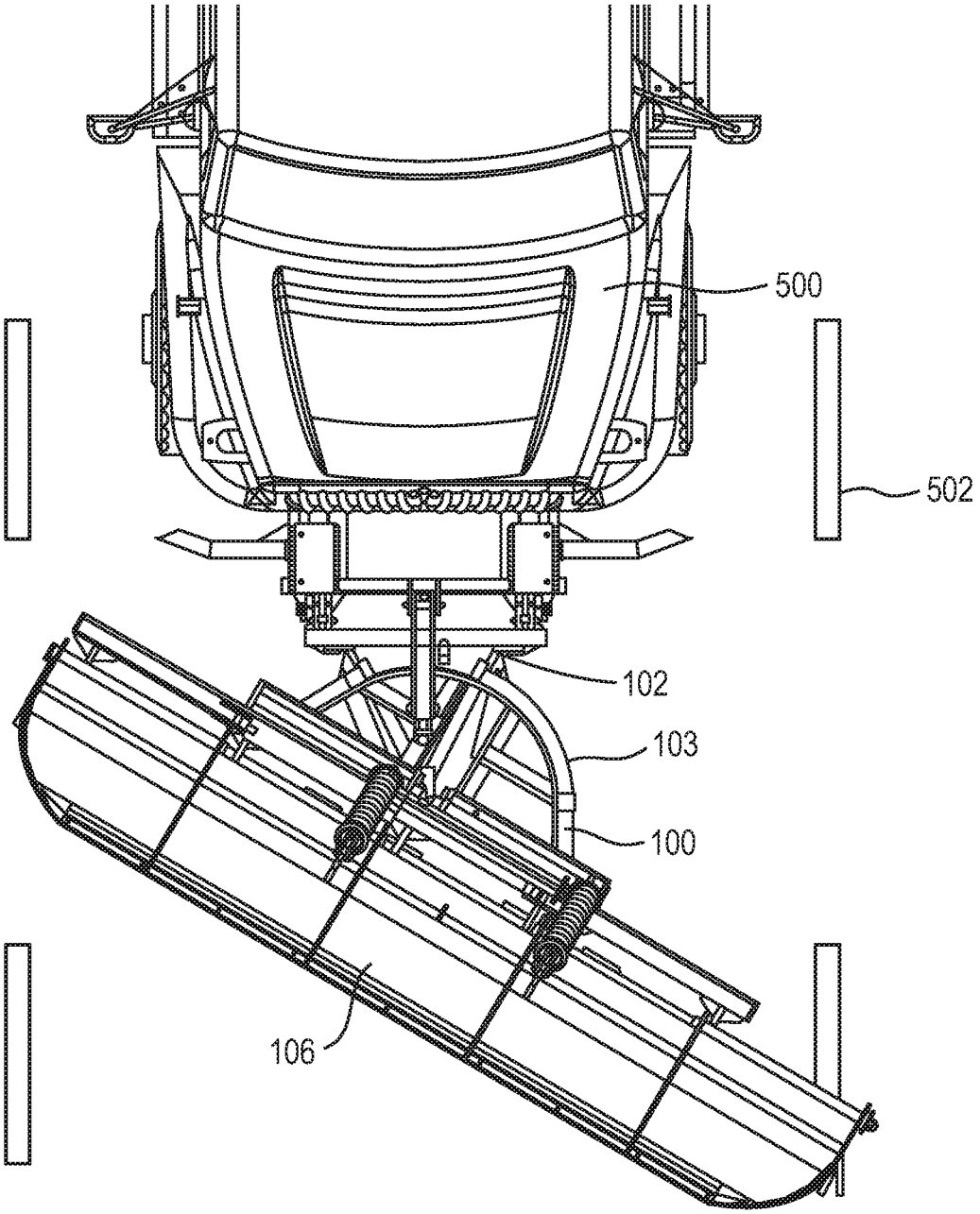
Figure 5B:
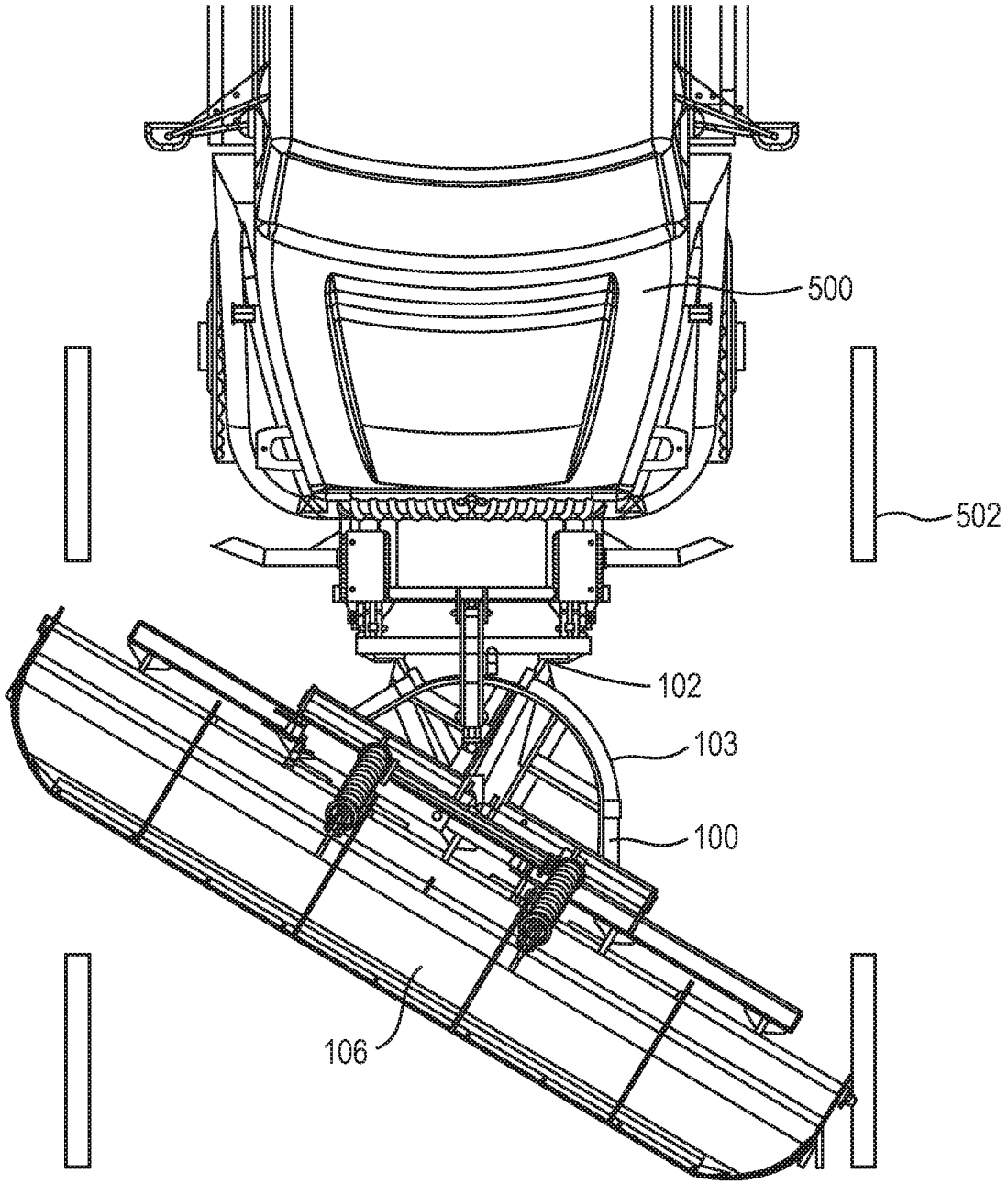
Figure 5C:
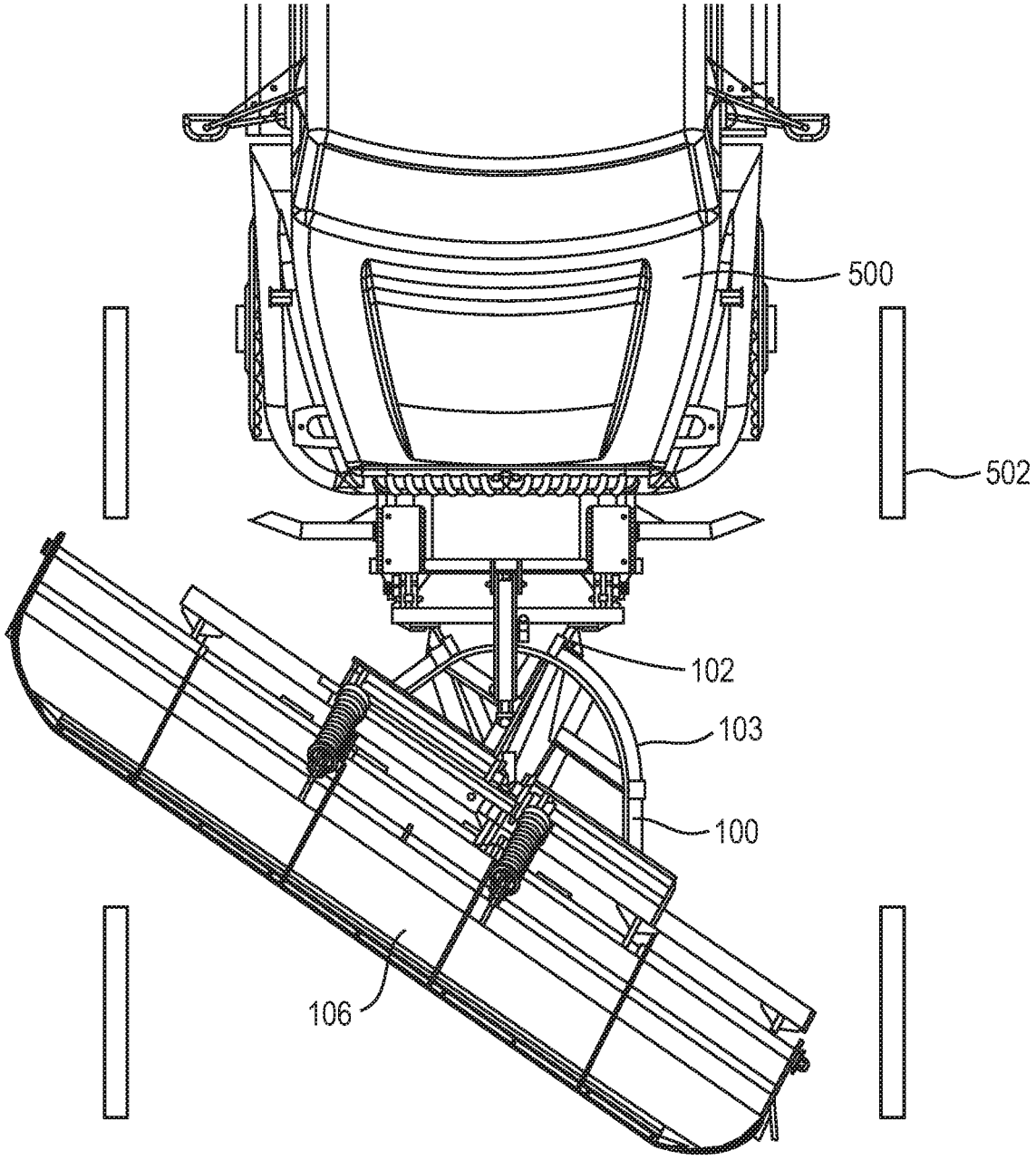

FIG. 3 provides side elevation view of the shiftable plow of FIG. 1;

FIG. 4 provides side elevation view of the shiftable plow of FIG. 1; and FIGS. 5A-5C provide different views of a motor vehicle equipped with a shiftable plow of FIG. 1 wherein FIG. 5A shows the plow shifted to the right, FIG. 5B shows the plow centered and FIG. 5C shows the plow shifted to the left.

DETAILED DESCRIPTION OF THE INVENTION

Several preferred embodiments of the invention are illustrated in the enclosed Figures in which:

Referring to the drawings, FIG. 1 illustrates a side shift push frame according to an exemplary embodiment of the disclosure. The side shift push frame assembly 100 includes a bracket 102 which is attachable to a front of a motor vehicle 500, such as a truck, for pushing a plow. In various exemplary embodiments according to the disclosure, the bracket 102 is attached to the motor vehicle 500 in any suitable manner, for example, by welding, bolting, etc. such that a center of the bracket 102 substantially coincides (within 10%) with a lateral (right-left) center of the front of the motor vehicle 500.

In an exemplary embodiment of the disclosure, there is a rotatable frame 103 including a mold board support beam 104 for attaching and supporting a mold board 106 on the rotatable frame 103. The rotatable frame 103 is rotatably attached to the bracket 102 on a side of the bracket 102 which faces away from the motor vehicle 500. The mold board support beam 104 extends lengthwise in the lateral direction. The rotatable frame 103 can pivot relative to the bracket 102 about a vertical axis to change an angle of the mold board 106 relative to the bracket 102, and thus relative to the front of the motor vehicle 500. Arranged at intervals along a side of the mold board support beam 104 facing away from the motor vehicle 500 are lower slide shaft brackets 108 including through-holes 110 having arranged therein bushings 112. A lower portion of the mold board 106 is attachable to the side shift push frame assembly 100 via a lower slide shaft 114 provided on a rear of the mold board 106 (i.e., the side of the mold board 106 intended to face the motor vehicle 500). The lower slide shaft 114 may pass through the through-holes 110 of the lower slide shaft brackets 108 while being supported by the bushings 112.

The number of lower slide shaft brackets 108 arranged on the mold board support beam 104 can be any suitable number. As shown in FIG. 1, in an exemplary embodiment, there can be five lower slide shaft brackets 108. The lower slide shaft 114 can be arranged as a single shaft extending across the entire rear face of mold board 106 or can be divided, for example, into two separate shafts, arranged at opposite ends of the mold board 106.

In an exemplary embodiment of the disclosure as depicted in FIGS. 1, 3 and 4, the rotatable frame 103 of the side shift push frame assembly 100 is attachable to an upper portion of the mold board 106 via a resilient force assembly 116 for biasing the mold board 106 toward the surface to be cleared of snow or other material. The resilient force assembly 116 includes a first upper slide shaft 118 and a second upper slide shaft 120. Resilient members 122, such as, for example, coil springs or pneumatic dampers include retaining plates 124 at one end. The retaining plates 124 are provided with through-holes 110 having bushings 112. A support beam 123 can be arranged between the resilient members 122, for example, to connect the resilient members 122 to one another. The first upper slide shaft 118 and the second upper slide shaft 120 are arranged to pass through respective through-holes 110 so that the retaining plates 124 can travel laterally along the respective slide shafts while the slide shafts remained fixed relative to the rotatable frame 103. In various exemplary embodiments of the disclosure, two or more resilient members 122 can be used to provide a stable biasing force and reduce movement of the mold board 106 as a result of coming in contact with objects on the roadway such as manhole covers or debris.

Figure 2:
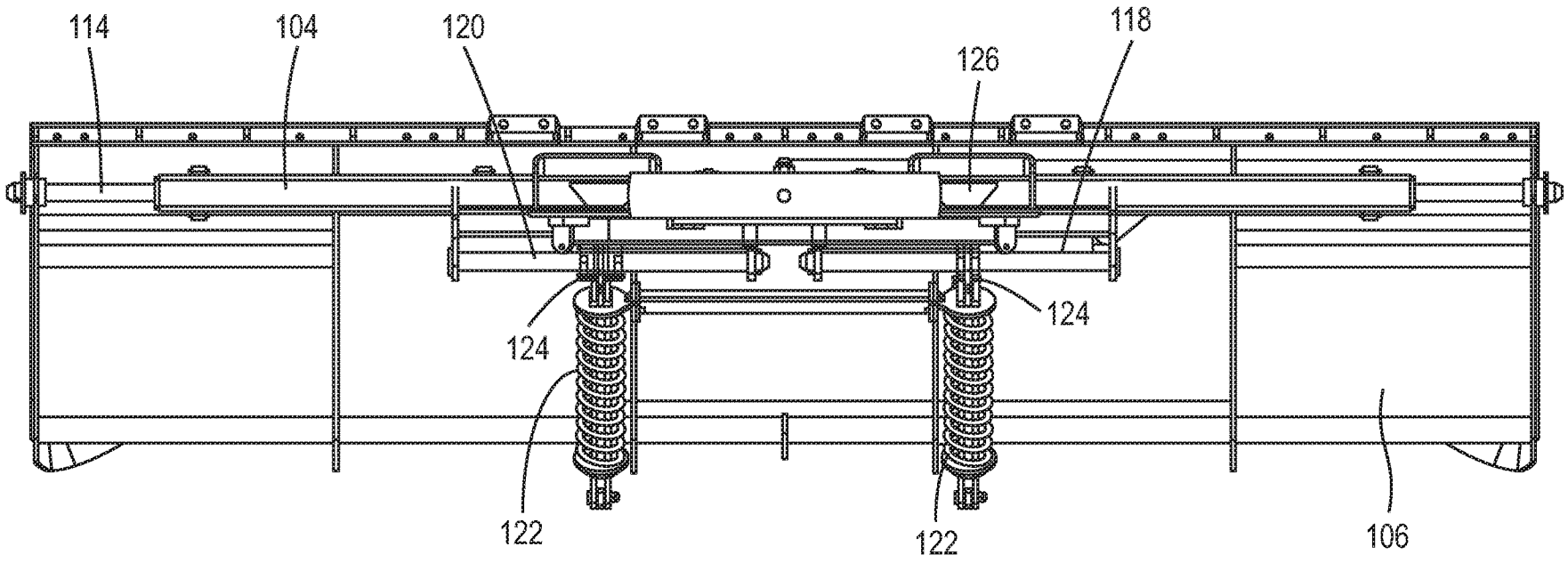
FIG. 2 depicts an underside view of the shiftable plow of FIG. 1.

In an exemplary embodiment of the disclosure depicted in FIGS. 1 and 2, an actuator 126 is provided to shift the mold board 106 in a direction that is to the left or right of the rotatable frame 103 (i.e., the actuator 126 is configured to laterally move the mold board 106 relative to the front of the motor vehicle 500). In various exemplary embodiments, the mold board 106 can be shifted 13" (thirteen inches) to the left of center, wherein in a centered position a center of the mold board 106 is aligned (within 10%) with the center of the rotatable frame 103 divided from a right side to a left side. The mold board 106 can be shifted 13" to the right of center in the same fashion. The length of the shift can be any suitable distance, depending on the size of the road, the size of the mold board 106 and the size of the motor vehicle 500.

The actuator 126 can be any suitable actuator 126 such as a hydraulically operated cylinder, a hydraulic motor or an electric motor. The actuator 126 can be a dedicated device for shifting the mold board 106 to the left or right or can be arranged to provide other control of the mold board 106 such as rotating the mold board 106 via the rotatable frame 103 or moving the mold board 106 in an up/down direction (i.e., vertically raising/lowering the mold board 106 and/or changing the vertical pitch of the mold board 106).

When the mold board 106 is shifted laterally to the left or right, the lower slide shaft 114, rigidly attached to the mold board 106, travels through the bushings 112 of lower slide shaft brackets 108 attached to the mold board support beam 104 of the side shift push frame assembly 100. The upper portion of the mold board 106 includes resilient member attachment brackets 128 arranged substantially equidistance (within 10%) from a top center of the mold board 106 in the lateral direction. The resilient force assembly 116 may be attached to resilient member attachment brackets 128, for example, as shown in FIGS. 3 and 4. When the mold board 106 is shifted laterally to the left or the right, the resilient force assembly 116 will travel in the same direction as the mold board 106, with the retaining plates 124 travelling on the first upper slide shaft 118 and the second upper slide shaft 120 respectively. A force is imparted to the resilient force assembly 116 from the mold board 106 via the resilient member attachment brackets 128 to provide the motive force. In this way, the resilient force assembly 116 is always maintained substantially (within 10%) at a center of the mold board 106.

In an exemplary embodiment according to the disclosure, control for the actuator 126 of the side shift push frame can be provided in the cab of the motor vehicle 500 via a joystick or other suitable interface.

FIG. 5A depicts the side shift push frame assembly 100 attached to the front of a motor vehicle 500. As can be seen in FIG. 5A, the mold board 106 has been shifted to the right of the road 502 when facing the motor vehicle 500. The resilient force assembly 116 is maintained centered on the mold board 106 and has shifted to the right with respect to the rotatable frame 103, which maintains its position relative with the motor vehicle 500.

FIG. 5B depicts the side shift push frame assembly 100 wherein the mold board 106 is centered (within 10%) with respect to the resilient force assembly 116, the rotatable frame 103 and the motor vehicle 500.

FIG. 5C depicts the side shift push frame assembly 100 attached to the front of a motor vehicle 500. As can be seen in FIG. 5C, the mold board 106 has been shifted to the left of the road 502 when facing the motor vehicle 500. The resilient force assembly 116 is maintained substantially centered on the mold board 106 and has shifted to the left with respect to the rotatable frame 103, which maintains its position relative with the motor vehicle 500.

The foregoing description of the specific embodiments will so fully reveal the general nature of the invention that others can, by applying knowledge within the skill of the art, readily modify and/or adapt for various applications such specific embodiments, without undue experimentation, without departing from the general concept of the present invention. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

Although the invention is illustrated and described herein with reference to specific embodiments, the invention is not intended to be limited to the details shown. Rather, various modifications may be made in the details within the scope and range equivalents of the claims and without departing from the invention.

What is claimed is:

1. A side shift push frame assembly, comprising:

a bracket arranged on a first side and configured to be attached to a vehicle;

a frame configured to be attached to the bracket;

a mold board support beam arranged on the frame on a side opposite to the bracket, and configured to be attached to a mold board;

an actuator configured to be attached to the mold board for linearly moving the mold board in a lateral direction relative to the frame while the frame remains in a fixed position.

2. The side shift push frame assembly according to claim 1, further comprising:

at least one upper slide shaft arranged on the frame;

a resilient force assembly including at least one resilient member configured to impart a force on the mold board, the at least one resilient force assembly configured to be fixed to the mold board at one end, and at another opposite end including at least one bore for receiving a respective slide shaft of the at least one upper slide shaft which is configured to travel through the bore, wherein the resilient force assembly is configured to move along with the mold board.

3. The side shift push frame assembly according to claim 1, wherein the frame is rotatable.

4. The side shift push frame assembly according to claim 2, wherein the at least one resilient member comprises a coil spring.

5. The side shift push frame assembly according to claim 1, wherein the actuator is a hydraulic cylinder.

6. The side shift push frame assembly according to claim 1, wherein the actuator is a hydraulic motor.

7. The side shift push frame assembly according to claim 1, wherein the actuator is an electric motor.

8. A side shift push frame assembly, comprising:

a bracket arranged on a first side and configured to be attached to a vehicle;

a frame configured to be attached to the bracket;

a mold board;

a mold board support beam arranged on the frame on a side opposite to the bracket, and configured to be attached to the mold board;

an actuator configured to be attached to the mold board for moving the mold board in a lateral direction relative to the frame while the frame remains in a fixed position;

at least one upper slide shaft arranged on the frame; and a resilient force assembly including at least one resilient member configured to impart a force on the mold board, the at least one resilient force assembly configured to be fixed to the mold board at one end, and at another opposite end including at least one bore for receiving a respective slide shaft of the at least one upper slide shaft which is configured to travel through the bore, wherein the resilient force assembly is configured to move along with the mold board, wherein the mold board comprises:

at least one upper flange arranged on an upper part of the mold board and connected to the resilient force assembly;

a lower slide shaft, wherein the mold board support beam includes a plurality of flanges each having a bore, the lower slide shaft being arranged to slide laterally in the bores of the plurality of flanges and is supported thereby.

9. A vehicle comprising:

a vehicle body; and a side shift push frame assembly, the side shift push frame assembly comprising:

a bracket arranged on a first side and configured to be attached to the vehicle body;

a frame configured to be attached to the bracket;

a mold board support beam arranged on the frame on a side opposite to the bracket, and configured to be attached to a mold board; and an actuator configured to be attached to the mold board for linearly moving the mold board in a lateral direction relative to the frame while the frame remains in a fixed position.

10. The vehicle according to claim 9, wherein the side shift push frame assembly comprises:

at least one upper slide shaft arranged on the frame;

a resilient force assembly including at least one resilient member configured to impart a force on the mold board, the at least one resilient force assembly configured to be fixed to the mold board at one end, and at another opposite end including at least one bore for receiving a respective slide shaft of the at least one upper slide shaft which is configured to travel through the bore, wherein the resilient force assembly is configured to move along with the mold board.

11. The vehicle according to claim 9, wherein the frame is rotatable.

12. The vehicle according to claim 9, wherein the at least one resilient member comprises a coil spring.

13. The vehicle according to claim 9, wherein the actuator is a hydraulic cylinder.

14. The vehicle according to claim 9, wherein the actuator is a hydraulic motor.

15. The vehicle according to claim 9, wherein the actuator is an electric motor.

16. A vehicle comprising:

a vehicle body; and a side shift push frame assembly, the side shift push frame assembly comprising:

a bracket arranged on a first side and configured to be attached to the vehicle body;

a frame configured to be attached to the bracket;

a mold board;

a mold board support beam arranged on the frame on a side opposite to the bracket, and configured to be attached to the mold board;

an actuator configured to be attached to the mold board for moving the mold board in a lateral direction relative to the frame while the frame remains in a fixed position;

at least one upper slide shaft arranged on the frame; and a resilient force assembly including at least one resilient member configured to impart a force on the mold board, the at least one resilient force assembly configured to be fixed to the mold board at one end, and at another opposite end including at least one bore for receiving a respective slide shaft of the at least one upper slide shaft which is configured to travel through the bore, wherein the resilient force assembly is configured to move along with the mold board, wherein the mold board comprises:

at least one upper flange arranged on an upper part of the mold board and connected to the resilient force assembly;

a lower slide shaft, wherein the mold board support beam includes a plurality of flanges each having a bore, the lower slide shaft being arranged to slide laterally in the bores of the plurality of flanges and is supported thereby.

17. The side shift push frame assembly according to claim 1, wherein the actuator is configured to linearly move the mold board in the lateral direction relative to the mold board support beam while the mold board support beam remains in a fixed position.

18. The vehicle including according to claim 9, wherein the actuator is configured to linearly move the mold board in the lateral direction relative to the mold board support beam while the mold board support beam remains in a fixed position relative to the vehicle body.

19. The side shift push frame assembly according to claim 2 in combination with a mold board wherein the mold board comprises:

at least one upper flange arranged on an upper part of the mold board and connected to the resilient force assembly;

a lower slide shaft, wherein the mold board support beam includes a plurality of flanges each having a bore, the lower slide shaft being arranged to slide laterally in the bores of the plurality of flanges and is supported thereby.

20. The vehicle according to claim 10 in combination with a mold board wherein the mold board comprises:

at least one upper flange arranged on an upper part of the mold board and connected to the resilient force assembly;

a lower slide shaft, wherein the mold board support beam includes a plurality of flanges each having a bore, the lower slide shaft being arranged to slide laterally in the bores of the plurality of flanges and is supported thereby.

21. The side shift push frame assembly according to claim 1, wherein the actuator is configured to be attached to the mold board for linearly moving the mold board in the lateral direction relative to the frame while the frame remains in the fixed position relative to the bracket, such that the mold board is linearly displaceable relative to both the frame and the bracket, and wherein the mold board and the frame are rotatable together relative to the bracket.

22. The vehicle according to claim 9, wherein the actuator is configured to be attached to the mold board for linearly moving the mold board in the lateral direction relative to the frame while the frame remains in the fixed position relative to the bracket, such that the mold board is linearly displaceable relative to both the frame and the bracket, and wherein the mold board and the frame are rotatable together relative to the bracket.

* * * * *